US006314393B1

(12) United States Patent
Zheng et al.

(10) Patent No.: US 6,314,393 B1
(45) Date of Patent: Nov. 6, 2001

(54) PARALLEL/PIPELINE VLSI ARCHITECTURE FOR A LOW-DELAY CELP CODER/DECODER

(75) Inventors: Yue-Peng Zheng, Ocean Township, NJ (US); Shvetal K. Patel, Germantown; Kumar Swaminathan, North Potomac, both of MD (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/270,918

(22) Filed: Mar. 16, 1999

(51) Int. Cl.[7] ..... G10L 19/12

(52) U.S. Cl. ..... 704/223; 701/222; 701/262; 701/200; 370/216; 370/535; 375/240.22; 375/240.12

(58) Field of Search ..... 704/200.1, 219, 704/220, 221, 222, 223, 230, 229, 262, 200; 370/216, 535, 536, 537, 521, 498; 375/240.22, 240.12, 246

(56) References Cited

U.S. PATENT DOCUMENTS 5,659,659 * 8/1997 Kolesnik et al. ..... 704/219
5,926,786 * 7/1999 McDonough et al. ..... 704/224

OTHER PUBLICATIONS

Higgins ("5.3 DSP Architecture issues: tradeoffs, pipelining, and parallelism", Digital Signal Processing in VLSI Prentice–Hall, Inc, Analog Devices, Inc, Norwood, MA 02062, 1990, pp. 256–293, 513–524).*

Suen et al., ("A programmable application–specific CELP processor with parallel architectures", IC Conference Proceedings., 1996 IEEE International Conference on Acoustics, Speech, and Signal Processing, vol.6, pp. 3252–3255).*

Drolshagen et al., ("A residue Number Arithmetic based Circuit for Pipelined Computation of Autocorrelation Coefficients of Speech Signal", Proceedings., 1998 Eleventh International Conference on VLSI Design, 1998, Jan. 1998, pp. 122–127).*

Zhang ("Parallel VLSI neural system design for time–delay speech recognition computing", 1997, Proceedings, Advances in parallel and Distibuted Computing, Mar. 1997, pp. 12–17).*

Stonick et al., ("ARMA filter design for music analysis/synthesis", ICASSP–92., 1992 IEEE International Conference on Acoustics, Speech, and Signal Processing, vol.2, pp. 253–256, Mar. 1992).

Denk et al., ("Reconfigurable hardware for efficient implementation of programmable FIR filters", Proceedings of the 1998 IEEE International Conference on Acoustics, Speech and Signal Processing, May 1998, vol.5, pp. 3005–3008).

Suen et al., ("Dynamic partial search scheme for stochastic codebook of FS1016 CELP coder", IEE proceedings, Vision, Image and Signal Processing, Feb. 1995, pp. 52–58).

Suen et al., ("On the fixed–point error analysis and VLSI architecture for the FS1016 CELP decoder", Proceedings, IEEE international Symposium on Circuits and Systems, Jun. 1997, vol.3, pp. 2052–2055).

"High–Flying DSP Architectures" Linda Geppert, IEEE Spectrum, Nov. 1998, pp. 53–56.

* cited by examiner

*Primary Examiner*—William Korzuch
*Assistant Examiner*—Vijay B Chawan
(74) *Attorney, Agent, or Firm*—John T. Whelan; Michael W. Sales

(57) ABSTRACT

An integrated circuit for processing a speech signal in accordance with a CELP standard includes a plurality of processing elements coupled to a data bus in parallel. Each processing element includes a multiplier and an accumulator. The integrated circuit further includes an auxiliary processing element, which is also coupled to the data bus and has a division unit and a comparator. The plurality of processing elements and the auxiliary processing element are also coupled in a pipeline formation.

16 Claims, 7 Drawing Sheets

PARALLEL/PIPELINE VLSI ARCHITECTURE FOR A LOW-DELAY CELP CODER/DECODER

BACKGROUND OF THE INVENTION

1. Technical Field

The present invention relates generally to speech signal processing and, more particularly, to processors designed to implement codebook-excited linear prediction (CELP) speech coding and decoding.

2. Description of the Related Art

Speech signal encoding lowers the number of bits required to transmit an accurate digital representation of a speech signal. Lowering the bit rate without decreasing the data transmission rate, in turn, advantageously allows the number of speech signals transmitted within a given bandwidth to be increased. A lower bit rate may also provide better error protection. One particular encoding scheme, codebook-excited linear prediction (CELP) coding, has been used to lower the bit rate from 64 Kbit/sec (the rate at which standard pulse-code modulated speech is transmitted) to as low as 4.0 Kbit/sec. CELP coders are a class of analysis-by-synthesis coders. That is, the coding algorithm chooses coding parameters by reconstructing the speech signal from the potential coding parameters. As a result, a CELP coder performs the same algorithms utilized by a CELP decoder to determine which encoded signal is optimal.

In a low-delay CELP system (LD-CELP) such as the one set forth in CCITT Recommendation G.728, "Coding of Speech at 16 kbit/s Using Low-Delay Code Excited Linear Prediction" (Geneva, September, 1992), the reconstructed speech signal is synthesized by filtering an excitation signal through a synthesis filter constructed from short-term prediction coefficients. The excitation signal is derived from a gain-scaled contribution from a fixed codebook, which contains a set of excitation vectors that are characteristic of the speech signal being encoded.

The optimal codebook indices and gain coefficients are typically determined through the analysis-by-synthesis procedure. More particularly, each codebook vector may be evaluated to determine the vector and gain parameters that minimize the error between the synthesized signal and the actual speech signal.

Because each codebook entry must be evaluated for each speech segment, prior methods of implementing the CELP coder (and corresponding decoder) have required a high-performance, general-purpose digital signal processor (DSP). This general purpose DSP must also be capable of determining the optimum codebook vectors and gain parameters in real-time. Adequate general purpose DSPs, however, have been found to be undesirably expensive.

SUMMARY OF THE INVENTION

In accordance with one aspect of the present invention, an integrated circuit is useful for processing a speech signal in accordance with a CELP standard. The circuit includes a data bus, a plurality of processing elements coupled to the data bus in parallel, and an auxiliary processing element coupled to the data bus. Each processing element includes a multiplier and an accumulator, while the auxiliary processing element has a division unit and a comparator. The plurality of processing elements and the auxiliary processing element are also coupled in a pipeline formation.

In accordance with another aspect of the present invention, a speech coder that implements a CELP standard to code a speech signal includes a data bus, a first memory coupled to the data bus and storing quantized speech vectors, and a plurality of processing elements that operate on the quantized speech vectors and the speech signal. Each processing element of the plurality of processing elements is coupled to the data bus, and adjacent processing elements are coupled in a pipeline formation. The plurality of processing elements includes multiple multiply-accumulate processing elements and an auxiliary processing element having a division unit and a comparator. The speech coder further includes a second memory coupled to the auxiliary processing element and storing constant values utilized by the comparator of the auxiliary processing element.

DETAIL DESCRIPTION OF THE INVENTION

Figure 1:
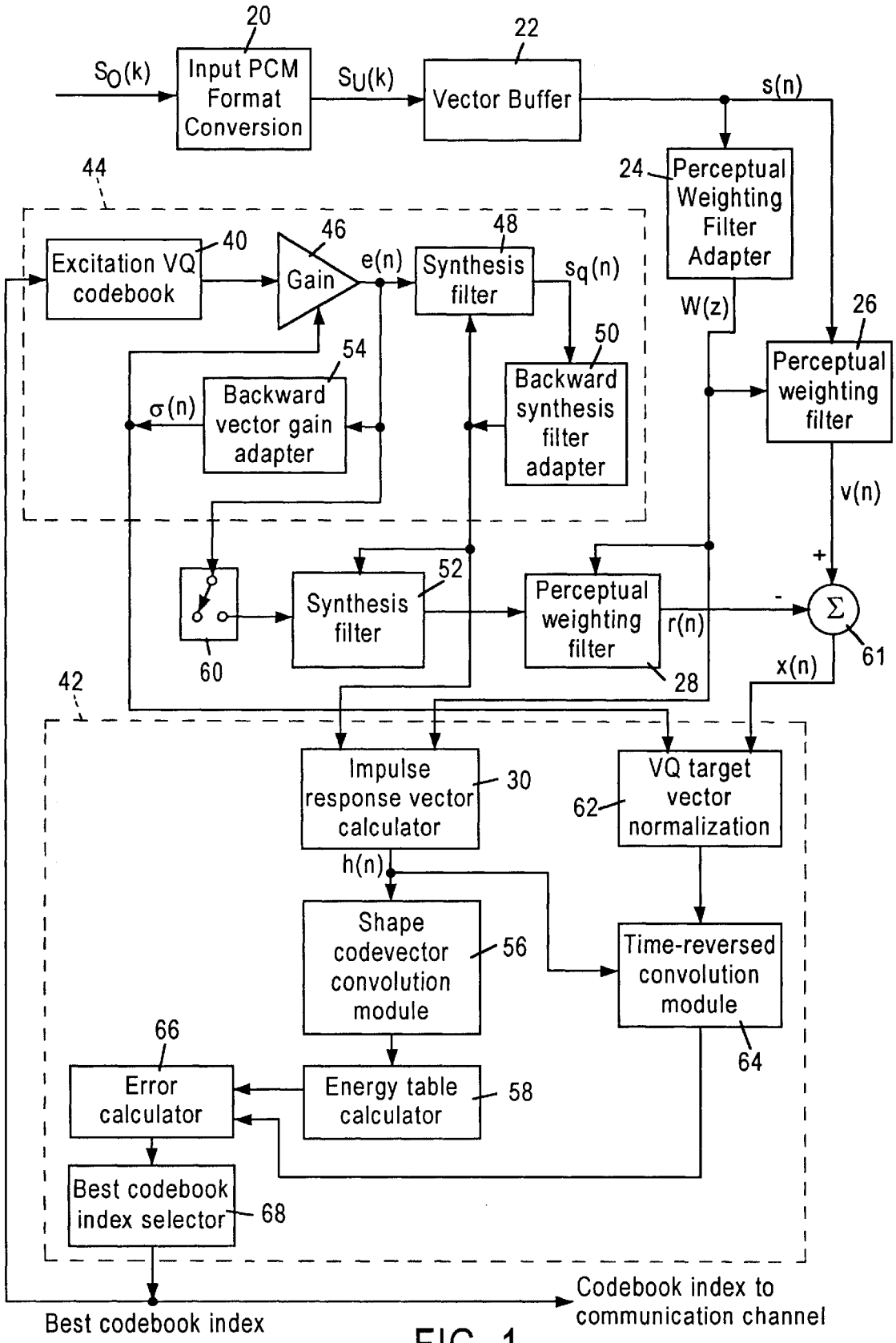
FIG. 1 is a block diagram of an LD-CELP encoder implemented by the present invention.

The present invention sets forth a VLSI integrated circuit architecture designed to implement an LD-CELP standard, such as the ITU-T G.728 LD-CELP standard promulgated in CCITT Recommendation G.728, the subject matter of which is hereby incorporated by reference. While the present invention is not limited to any particular CELP standard, the characteristics of the ITU-T G.728 LD-CELP standard provide one example of an efficient, global scheme for accomplishing codebook-excited speech processing. Therefore, references in the following description to "the LD-CELP standard" and the like should be understood to refer to the above-identified CCITT standard.

The LD-CELP Standard Coder/Decoder

In general, an LD-CELP encoder passes, for each input speech segment, 1024 candidate codebook vectors through a gain scaling unit and a synthesis filter. The encoder then identifies a best candidate codebook vector as the gain-modified candidate vector that minimizes a mean-squared error function with respect to the input speech segment. The codebook index associated with the best candidate codebook vector is transmitted to the decoder. The best candidate codebook vector is then passed through the gain scaling unit and the synthesis filter to prepare the encoder for the encoding of the next input speech segment. In this manner, the synthesis filter coefficients and the gain are updated periodically in a backward adaptive manner based on the previously quantized signal and the gain-scaled excitation.

An LD-CELP decoder relies on very similar processing steps. In general, the decoder first performs a codebook look-up to obtain the codevector corresponding to the transmitted codebook index. This codevector is then passed through a gain scaling unit and a synthesis filter (similar to those utilized by the encoder) to produce a decoded signal vector. The synthesis filter coefficients and the gain are then updated to reflect this latest decoded signal vector, and an adaptive postfilter enhances the perceptual quality of the decoded signal vector.

A more detailed description of the components of the processing involved in the LD-CELP standard will now be set forth in connection with FIG. 1. Initially, a block 20 receives a 64 Kbit/sec speech signal $s_o(k)$ and converts the speech signal from either an A-law or $\mu$-law pulse-code modulated (PCM) format to a linear (i.e., uniform) PCM speech signal $s_u(k)$. As used herein, the variable "k" simply denotes a sampling index. In addition to possibly being both A-law and $\mu$-law compatible, the block 20 may also have to adjust the linear range of the speech signal $s_o(k)$. Whether in A-law or $\mu$-law format, however, the speech signal $s_o(k)$ is sampled every 125 $\mu$s.

The uniform speech signal $s_u(k)$ is supplied to a vector buffer 22, which buffers five consecutive speech signal samples to form a speech vector s(n). A perceptual weighting filter adapter 24 then receives the speech vector s(n) for calculating linear prediction coefficients (LPCs) for a perceptual weighting filter 26, which, of course, also receives the speech vector s(n). The LPC analysis to determine these coefficients is preferably performed once every vector cycle, which translates into once every four speech vectors s(n). The filter coefficients of the perceptual weighting filter 26 are preferably updated at the third speech vector of every vector cycle to provide a two vector delay time to allow for upcoming, time-consuming recursion calculations.

The LPC analysis performed by the perceptual weighting filter adapter 24 involves a three-step procedure well-known to those skilled in the art and, thus, will only be set forth in brief detail. First, the speech vector s(n) is passed through a hybrid windowing module, which may calculate, for example, eleven autocorrelation coefficients for each speech vector s(n). These autocorrelation coefficients may be white-noise corrected at this point to reduce the spectral range of the coefficients and reduce any distortive effects of subsequent processing. The particular methods for determining the parameters of the hybrid windowing module and the white-noise correction are also well-known to those skilled in the art. A Levinson-Durbin recursion module then converts the autocorrelation coefficients to predictor coefficients, which are subsequently weighted to derive the coefficients of the perceptual weighting filter 26. The weighting preferably results in a 15 Hz bandwidth expansion in the interest of noise reduction. Alternatively, a Schur algorithm may be utilized to convert the autocorrelation coefficients into predictor coefficients. Further details (such as examples of autocorrelation and white-noise correction parameters) regarding the hybrid windowing and recursion modules may be found in the above-referenced CCITT publication.

The weighted predictor coefficients define a transfer function W(z) of the perceptual weighting filter 26 that filters (i.e., transforms) the speech vector s(n) into a weighted speech vector v(n). These same weighted predictor coefficients define a transfer function for an additional perceptual weighting filter 28, and are also provided to an impulse response vector calculator 30.

With continued reference to FIG. 1, for every speech vector s(n), the LD-CELP coder passes 1024 quantized vectors from an excitation codebook 40 through a codebook search module 42 to determine which codebook vector is closest to the unquantized speech vector s(n). More particularly, the codebook search module 42 identifies the index of the codevector that provides a quantized speech vector closest to the input speech vector. To do so, the codebook search module 42 may find the 10-bit codebook vector that minimizes a mean-squared error algorithm based on the unquantized speech vector s(n). Each 10-bit codebook vector may be formed from entries in a 7-bit "shape codebook" and a 3-bit "gain codebook." The gain codebook entries may, in turn, represent eight scalar gain levels symmetric with respect to zero. In this case, the optimal codevector is a product of the optimal shape codevector and the optimal gain level. Further details of the codebook search module 42 will be set forth hereinbelow.

Once the optimal codevector has been identified, the corresponding codebook index is provided to a simulated decoder 44 to prepare for the encoding of subsequent speech vectors. First, the index is provided to the codebook 40 to retrieve the appropriate codevector, which is then scaled by the current excitation gain $\sigma(n)$ by a gain stage 46 to provide a gain-scaled excitation vector e(n). The vector e(n) is then supplied to a synthesis filter 48, which develops a quantized speech vector $s_q(n)$ using the current linear prediction coefficients determined by a backward synthesis filter adapter 50. The backward synthesis filter adapter 50 receives the quantized speech vector $s_q(n)$ and utilizes a hybrid-windowing and Levinson-Durbin (or Schur algorithm) recursion scheme (similar to that described in connection with the perception weighting filter adapter 24) to generate LPC coefficients. To improve robustness to channel errors, these LPC coefficients may be bandwidth-expanded, which effectively widens the peaks of the frequency response. The backward synthesis filter adapter 50 also provides the same set of linear predictive coefficients to another synthesis filter 52 and the impulse response vector calculator 30. These linear predictive coefficients, like those for the perception weighting filters 26 and 28, are updated once every four speech vectors. Each synthesis filter may comprise a 50-th order all pole filter, while the backward synthesis filter adapter 50 may be considered part of a feedback loop having a 50-th order LPC predictor in the feedback path.

The simulated decoder 44 also includes a backward vector gain adaptor 54 that is responsive to the gain-scaled excitation vector e(n) to update the coefficients of a log-gain linear predictor (not shown) that develops the excitation gain $\sigma(n)$. The backward vector gain adapter 54 also utilizes the same linear prediction analysis (i.e., hybrid windowing and Levinson-Durbin recursion) to essentially predict the excitation gain $\sigma(n)$ based on previous gain-scaled excitation vectors (e.g., e(n−1), e(n−2)).

The linear prediction analysis for the backward vector gain adapter 54 begins by making the previous gain-scaled excitation vector e(n−1) available via a buffer or otherwise. The root-mean-square (RMS) value of the gain-scaled excitation vector e(n−1) is calculated and converted to a logarithmic value in dB. Next, a 32 dB offset (which corresponds with the average excitation gain level during voiced speech) is subtracted from the logarithmic value. The resulting value is processed by hybrid windowing and Levinson-Durbin recursion modules, which generate a 10th order linear predictor. After the set of LPCs are bandwidth-expanded, a linear predictor uses the bandwidth-expanded set of LPCs to predict the gain (in dB) for the current vector. To this end, the linear predictor is updated with a new set of bandwidth-expanded LPCs once every vector cycle.

The gain (in dB) may be limited if it is unreasonably large or small by a log-gain limiter (not shown). The upper and lower limits may, for example, be 0 and 60 dB. Lastly, the 32 dB offset is added back to the predicted gain value and a conversion from dB provides the excitation vector gain parameter $\sigma(n)$ for the current codebook vector.

The codebook search module 42 will now be further described. During each vector cycle, the synthesis filter 52 and the perceptual weighting filter 28 are updated, and the impulse response vector calculator 30 of the codebook search module 42 determines the first five samples of an impulse response h(n) of the cascaded filter F(z)W(z). F(z) is the transfer function of the synthesis filter 52 and is derived from the transfer function P(z) of the backward synthesis filter adapter 50, such that:

F(z)=1/[I−P(z)]. W(z), in turn, is the transfer function of the perceptual weighting filter adapter 24. Next, a shape codevector convolution module 56 convolves each shape codevector in the codebook 40 with the impulse response h(n). An energy table calculator 58 then computes the energy of each convolution vector, where an energy value is defined as the sum of the square of each convolution vector component. By re-organizing the terms of the error computations of the codebook search module 42 and noting that the codebook vectors are constant, it can be shown that these initial energy calculations need be performed only once per speech vector cycle. Thus, the results of these calculations are stored and used for the next four speech vectors.

To prepare for testing the weighted speech vector v(n) against the codebook 40, the current gain-scaled excitation vector e(n) is also provided to the synthesis filter 52 when a switch 60 is disposed in a first state. When the switch 60 is in a second state, the synthesis filter 52 is provided with a vector of zeros such that the output from the synthesis filter 52 and the perceptual weighting filter 28 is a zero-input response vector r(n). In effect, the vector r(n) constitutes the response of the cascaded filters 52 and 28 to the immediately previous gain-scaled excitation vectors e(n−1), e(n−2), etc. This "memory" of the filters 52 and 28 is established when the switch is disposed in the first state, which occurs after the memories are reset and the gain-scaled excitation vector e(n) is passed therethrough.

A target vector x(n) for the codebook search module 42 is then generated by a summer 61 having non-inverting and inverting terminals such that the summer 61 subtracts the zero-input response vector r(n) from the weighted speech vector v(n). A block 62 receives the target vector x(n) for normalization by the current excitation gain $\sigma(n)$. Next, a time-reversed convolution module 64 reverses the order of the components of the normalized target vector, convolves the resulting vector with the impulse response vector h(n), and reverses the order of the results of the convolution. An error calculator 66 then receives the vector output of the time-reversed convolution module 64, together with the energy values computed by the energy table calculator 58 and multiple terms derived from the gain levels of the gain codebook, and determines an error value for each shape codebook vector-gain level combination in accordance with the procedures set forth in the above-identified CCITT standard publication. Lastly, a block 68 determines the optimal gain level and the optimal shape codebook vector from the error values determined by the error calculator 66 and transmits the corresponding concatenated 10-bit codebook index to the communication channel.

LD-CELP Processor Architecture

The above-described LD-CELP standard may be divided into five computationally intensive functional blocks: (1) codebook energy computation; (2) codebook searching; (3) hybrid windowing; (4) Levinson-Durbin or Schur recursion; and, (5) reflection coefficient to weighting filter coefficient transformation. Multiple directed acyclic graphs may then be utilized to expose the data flow of each of these functional blocks, thereby displaying the regularity, parallelism, and pipelineability thereof. For instance, the computations involved in the shape vector convolution module 56 (FIG. 1) may be shown to rely on five multiply-accumulate operations and one square-accumulate operation, all of which may be performed in parallel. From this, we may conclude that at least six processing elements may be needed, each of which has general-purpose multiply-accumulate functionality. Conversion from reflection coefficients to filter coefficients also involves a series of multiply-accumulate operations.

Figure 2A:
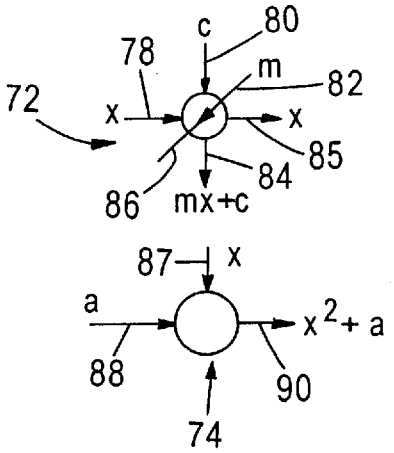
FIG. 2A is a schematic representation of processing blocks used to depict the data flow of the CELP standard followed by the LD-CELP encoder of FIG. 1.
Figure 2B:
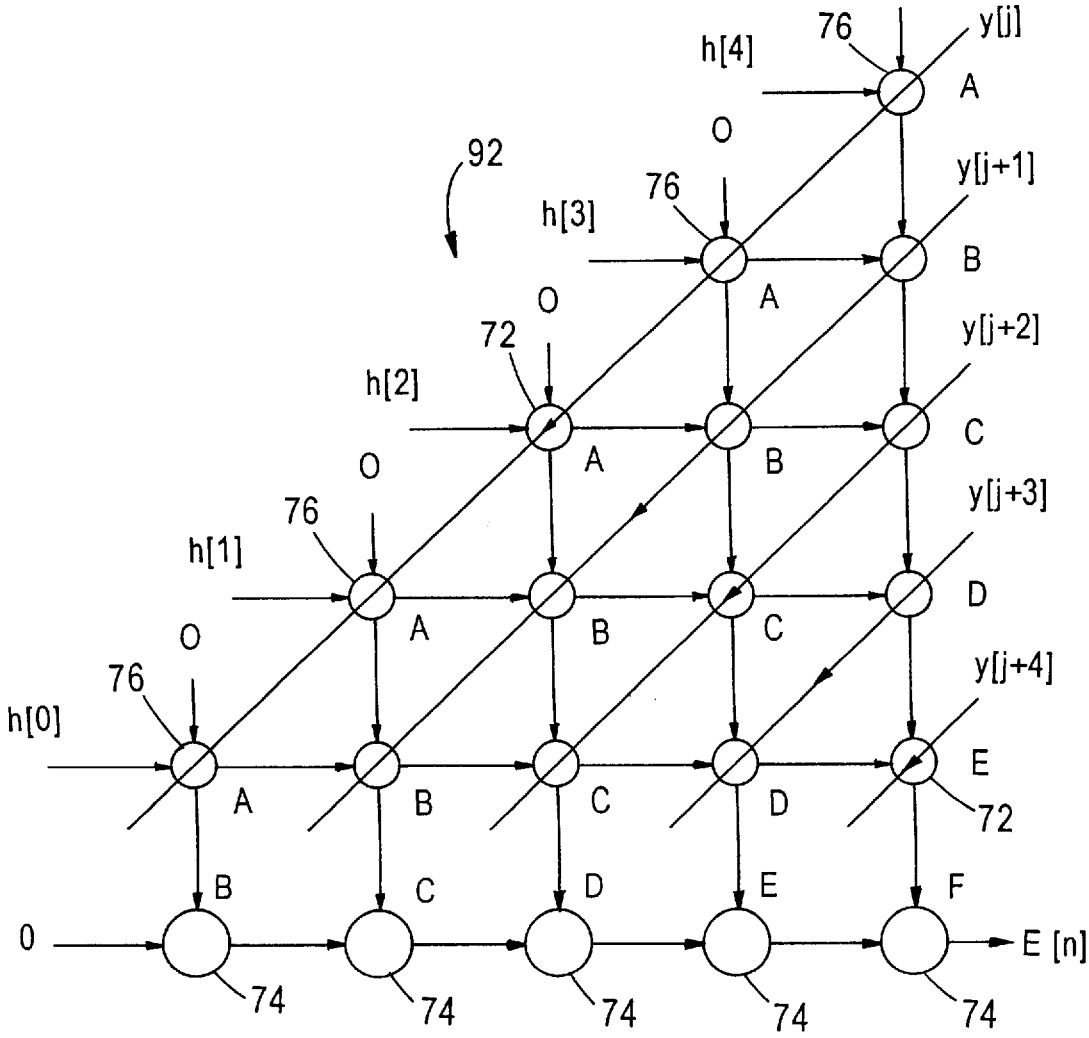
FIG. 2B is a directed acyclic graph of the data flow during the computation of a codebook vector energy by the processing blocks of FIG. 2A.

With reference to FIGS. 2A and 2B, an exemplar directed acyclic graph 70 includes multiple computational blocks 72, 74, 76. In particular, FIG. 2A shows the computational blocks 72, 74 in greater detail by identifying their respective outputs as a function of their respective inputs. For example, each block 72 takes three inputs "x," "c," and "m" on lines 78, 80, and 82, respectively, and generates an output "mx+c" on a line 84 and passes the inputs "x" and "m" on lines 85 and 86, respectively. The block 76 (FIG. 2B) is similar, inasmuch as each block 76 computes "mx+c" with "m" set to one. Lastly, the block 74 computes the square of an input "x" provided on a line 87 and adds an input "a" provided on a line 88 to develop an output value "$x^2$+a" on a line 90.

FIG. 2B shows the computational blocks 72, 74, 76 incorporated into a directed acyclic graph 92 for computing the codebook energy term E[n] for the n-th codebook vector. The input data values h[0] . . . h[4] represent the impulse response h(n) developed by the impulse response vector calculator 30 (FIG. 1), while the input data values y[j] . . . y[j+4] (where j=5*n) represent a group of codevectors from the codebook 40 (FIG. 1). The letters A–F are representative of the timing of the particular computation, with time A being first and progressing to the last computation at time F.

The convolution of the impulse response with the codebook vectors is represented graphically by FIG. 2B, thereby exposing the regularity, parallelism, and pipelining of the data involved in the computation of the energy values E[n]. The graph, for instance, shows that five multiply-accumulate elements would be desirable to implement the calculations for time A. Furthermore, it is evident that the data must be pipelined to a single processing element that is capable of squaring an input and accumulating. In general, however, those skilled in the art shall recognize from this example that graphs like that of FIG. 2B may be utilized to depict the data flow in order to design an efficient processing architecture for the CELP standard.

From other graphs generated from the CELP standard, it may be further noticed that all of the calculations involving the impulse response h(i) (as determined by the impulse response vector calculator 30) for a given i may be handled by a single processing element (for a total of five processing elements). Still further, it may be noted that all of the shape codebook vector entries must be broadcast to each of the processing elements for the purposes of these calculations, thereby requiring parallel connections to a global data bus. Finally, the energy computation (along with others) may be seen as requiring the pipelining of the output of a prior processing element to an input of a subsequent processing element.

As set forth above, the codebook search module 42 searches through the candidate code vectors in the codebook 44 and identifies the index of the code vector closest to the input speech vector. In addition to the processing associated with calculating the energy of each shape codebook vector, the codebook search module 42 also determines the correlation between the shape codebook vectors and the target vector (which may be normalized by the block 62). It can be shown via an appropriate directed acyclic graph that the data flow in this codebook search may conform to the processing architecture set forth in connection with the codebook energy computations. More particularly, the multiply-accumulate processing elements may handle all of the processing with the exception of floating-point division, floating point comparison, and a few other operations. These operations may, therefore, be supplied by an auxiliary processing element so that the correlation and gain computations may be performed efficiently in parallel.

Figure 3:
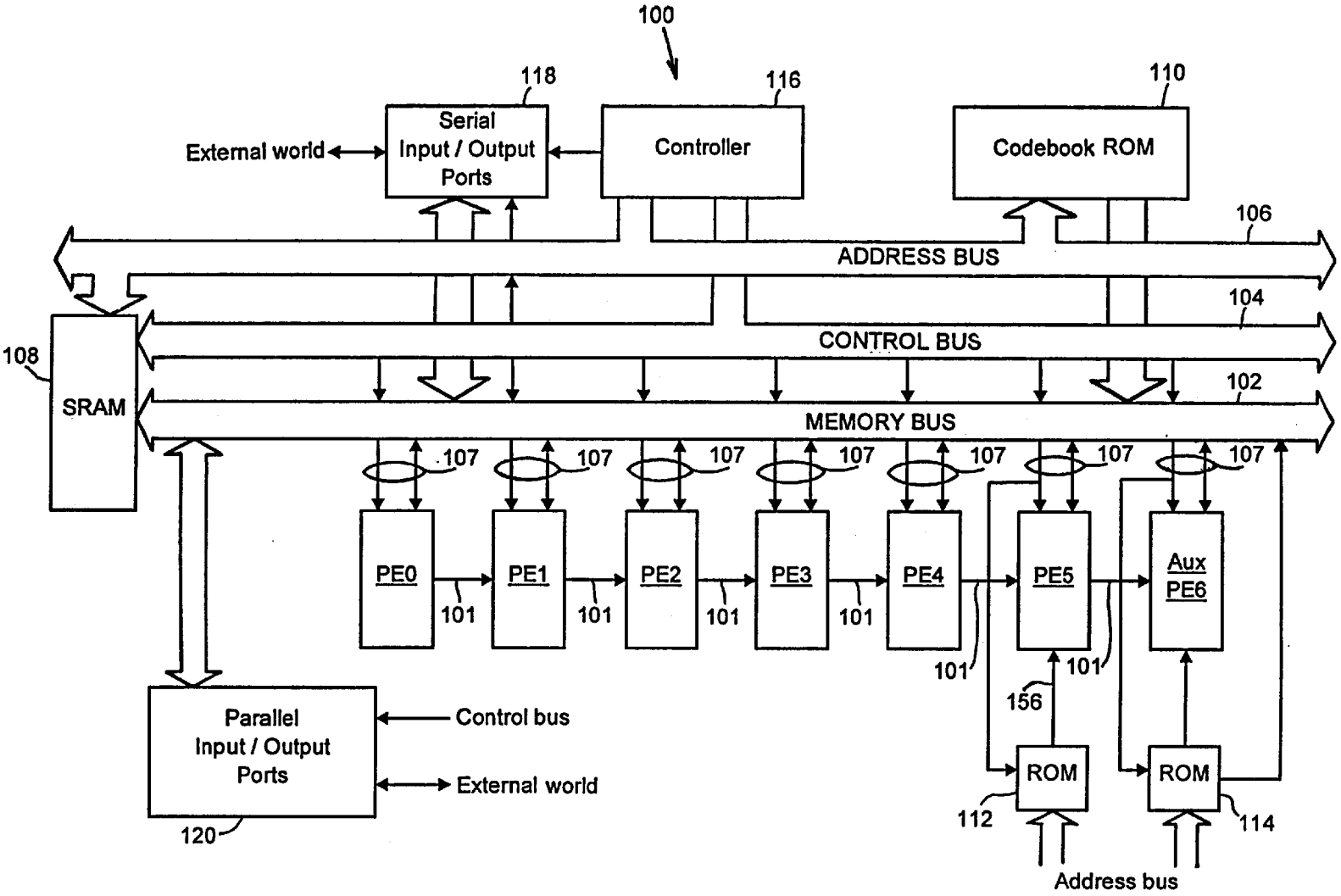
FIG. 3 is a simplified block diagram of the architecture of an LD-CELP processor according to the present invention.

After analyzing each of the five computationally intensive functional blocks of the LD-CELP standard using the directed acyclic graph methodology, an LD-CELP processor 100 in accordance with the present invention may have the architecture shown in FIG. 3. The processor 100 includes a plurality of basic processing elements PE0–PE5 and an auxiliary processing element PE6. In one embodiment, there are five basic processing elements PE0–PE4 corresponding to the dimension of a single speech vector, together with an additional basic processing element PE5 for computing the energy terms in the codebook search module 42. These basic processing elements PE0–PE5 are generally arranged in a fashion suitable for parallel processing. In particular, the processing element PE5 may be utilized in squaring and accumulating the results obtained from the other basic processing elements PE0–PE4, while the auxiliary processing element PE6 may be utilized to implement special functions required by the LD-CELP standard. The processing elements PE0–PE6 (collectively referred to as "processing array PE0–PE6") are connected in a pipeline formation by lines 101.

As shown in FIG. 3, the processing elements PE0–PE6 are coupled in parallel to a memory or data bus 102, a control bus 104, and an address bus 106 via lines 107. The global buses 102, 104, and 106, in turn, are coupled to a random access memory 108, which may comprise a 2K×32 bit SRAM. The data bus 102 and the address bus 106 are also coupled to a codebook ROM 110 and two auxiliary ROMs 112 and 114 dedicated to the processing elements PE5 and PE6, respectively. A global controller 116 is responsible for guiding all activities in the processing array PE0–PE6 via the control bus 104.

As used herein, a processing element (either basic, auxiliary, or otherwise) shall be understood to refer to an element, block, section, component, and/or portion of an ASIC or other semiconductor chip that performs operations on data. Operations include both mathematical or other types of operations, such as comparisons and basic logical conditions. Data, in turn, should broadly include, without limitation, any type of information representative of a physical or tangible entity (or any aspect thereof), either directly or indirectly. Data should also be understood to include other information, such as a control signal, that will be utilized to obtain a useful, concrete, and tangible result.

In one particular embodiment of the present invention, the processing array PE0–PE6 does not operate on data that represents control signals or instructions. In such an embodiment, mathematical operations on control signals are handled by elements located in a global controller (such as the controller 116). In that embodiment, any control signals, instructions, or opcodes received by a processing element are processed only to the extent necessary to be followed (i.e., executed). In alternative embodiments, control of the processor 100 may be dispersed to the processing array or otherwise such that data may, in fact, include local control signals.

The processor 100 also includes both serial input/output ports 118 and parallel input/output ports 120, which provide an I/O interface to the external world for the controller 116, the data bus 102, and the remainder of the LD-CELP processor 100. The serial I/O ports 118 may be bidirectional and serve to read/write speech or data signals. The parallel I/O ports 120 may comprise a first unidirectional parallel port for reading parallel input during decoder operation and a second unidirectional port for writing parallel output during encoder operation.

An external clock (not shown) may be coupled to the components of the processor 100 via a dedicated clock input pin (not shown). The clock frequency is preferably 40 MHz. Two other clocks are also preferably provided from off-chip sources: an 8 kHz synchronization clock for sampling the input speech signal; and, a 2.048 MHz bit clock corresponding to the bitstream of speech/data input.

With regard to the memory blocks in particular, the RAM 108 may be external to the chip and used to store intermediate data values required during computation. In a preferred embodiment, however, the RAM 108 may reside on the chip in the interest of increasing processing speeds. The data values stored in the RAM 108 are preferably read/write in one clock cycle, but without simultaneous read/write operation. The codebook ROM 110 is preferably a memory block having a size of 640×16 bits, while storing the codebook vectors in Q11 format. The data bus 102 through which the processing array PE0–PE6 may access the RAM 108 and the codebook ROM 110 preferably comprises a 32-bit global data bus. The ROM 112 preferably comprises a 324×16 bit memory block that stores values for the hybrid windowing computations and weighting coefficients in Q14 format. The ROM 114 preferably comprises a 137×32 bit memory block that stores all of the floating point and integer constants required by the auxiliary processing element PE6 (e.g., the white noise correction factors). Unlike the ROM 112, which is local to the processing element PE5, the ROM 114 is coupled to the data bus 102 as well as the auxiliary processing element PE6.

Figure 4:
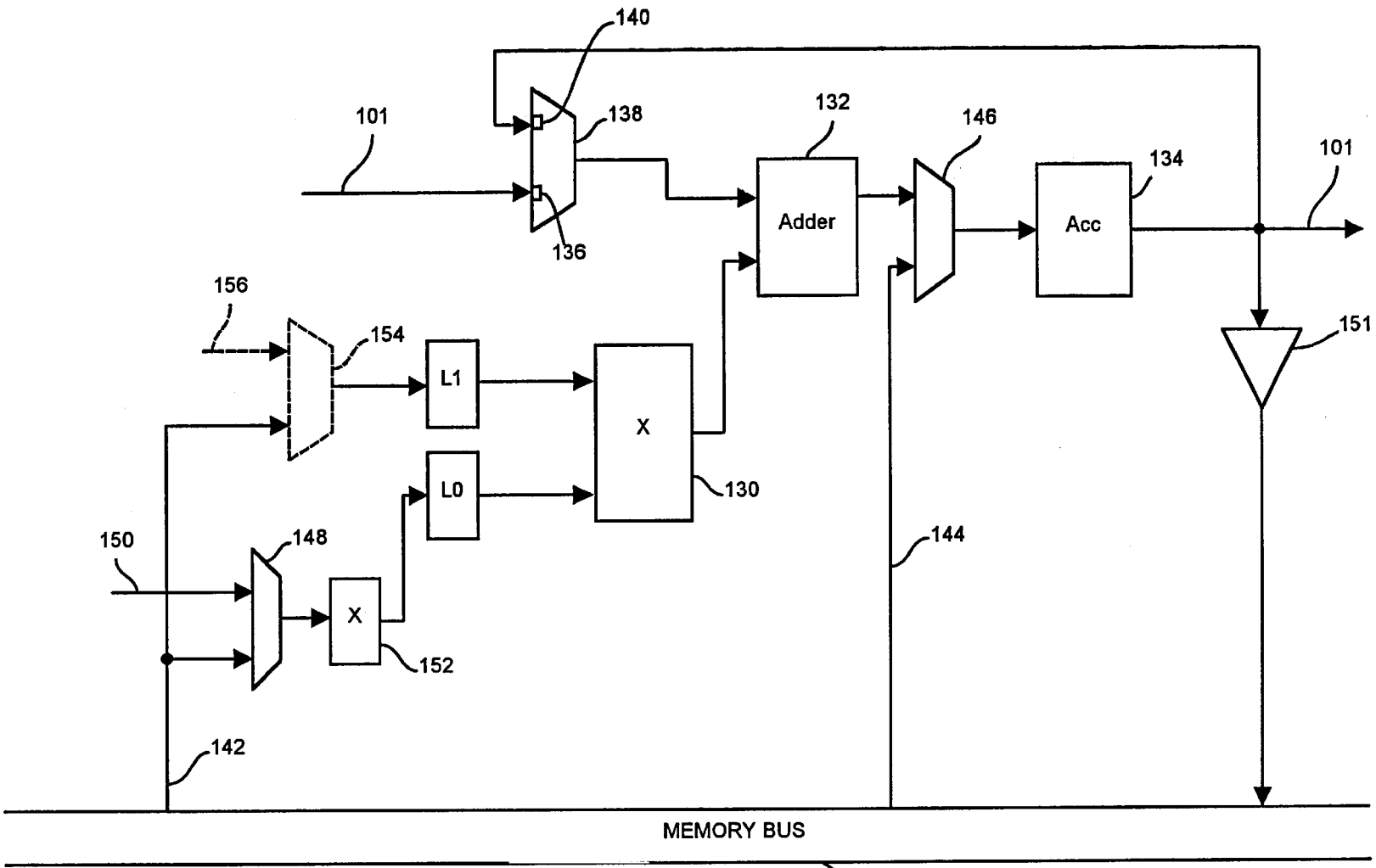
FIG. 4 is a block diagram of a basic processing element of the LD-CELP processor of FIG. 3.

Referring now to FIG. 4, the processing array preferably has five identical processing elements PE0–PE4, each of which comprises a floating point multiplier 130, an adder 132, and an accumulator 134. The output terminal of the accumulator 134 represents the output terminal of the processing element itself, which is, in turn, tied via the line 101 to a first input 136 of a multiplexer 138 (of the successive processing element). A second input 140 of the multiplexer 138 is tied to the output terminal of the accumulator 134 (of the same processing element). Each processing element PE0–PE4 is coupled to the data bus 102 via lines 142 and 144, which, in turn, are coupled to a latch L1 and a multiplexer 146, respectively. The lines 142 and 144 may correspond with the lines 107 of FIG. 3. In particular, the line 142 is also coupled to another multiplexer 148, which has a second input terminal coupled via a line 150 to an output terminal of a latch L0 (of the preceding processing element). Thus, each processing element PE0–PE4 is coupled to a successive processing element via the lines 101 and 150 in such a manner so as to permit pipeline processing. In one embodiment, the lines 101 and 150 comprise a 40-bit bus connecting successive processing elements. Of course, additional input data may be gathered using the lines 142 and 144, which permit data to be broadcast to/from the data bus 102. Data output to the data bus 102 may also be accomplished via a buffer 151 coupled to the output of the accumulator 134 (i.e., the line 101).

The multiplier 130 performs floating point multiplication on two 32-bit floating point inputs and generates a 40-bit product in preferably 12 clock cycles. The input data for the multiplier 130 may be latched in parallel or serially via the latches L0 and L1. A register block 152 is preferably provided for the latch L0 so that another data input can be latched while the previous input data is still being processed.

The processing element PE5 is identical to the above-described basic processing elements PE0–PE4 with the exception of an additional multiplexer 154 (shown in phantom) for multiplexing the input for the latch L1 between the data on the line 142 (from the data bus 102) and a line 156, which is coupled to the ROM 112 (see also FIG. 3).

The structure of the processing array PE0–PE5 is designed to exploit the parallelism and pipelineability exhibited by the computations performed during implementation of the LD-CELP standard. For example, the direct connections between adjacent processing elements reduces traffic on the data bus 102 and minimizes use of the RAM 108 and, therefore, the number of memory accesses. However, the processing elements PE0–PE5 need not act together as a pipeline processor, but may instead perform parallel computations and thereby act as independent processors.

Figure 5:
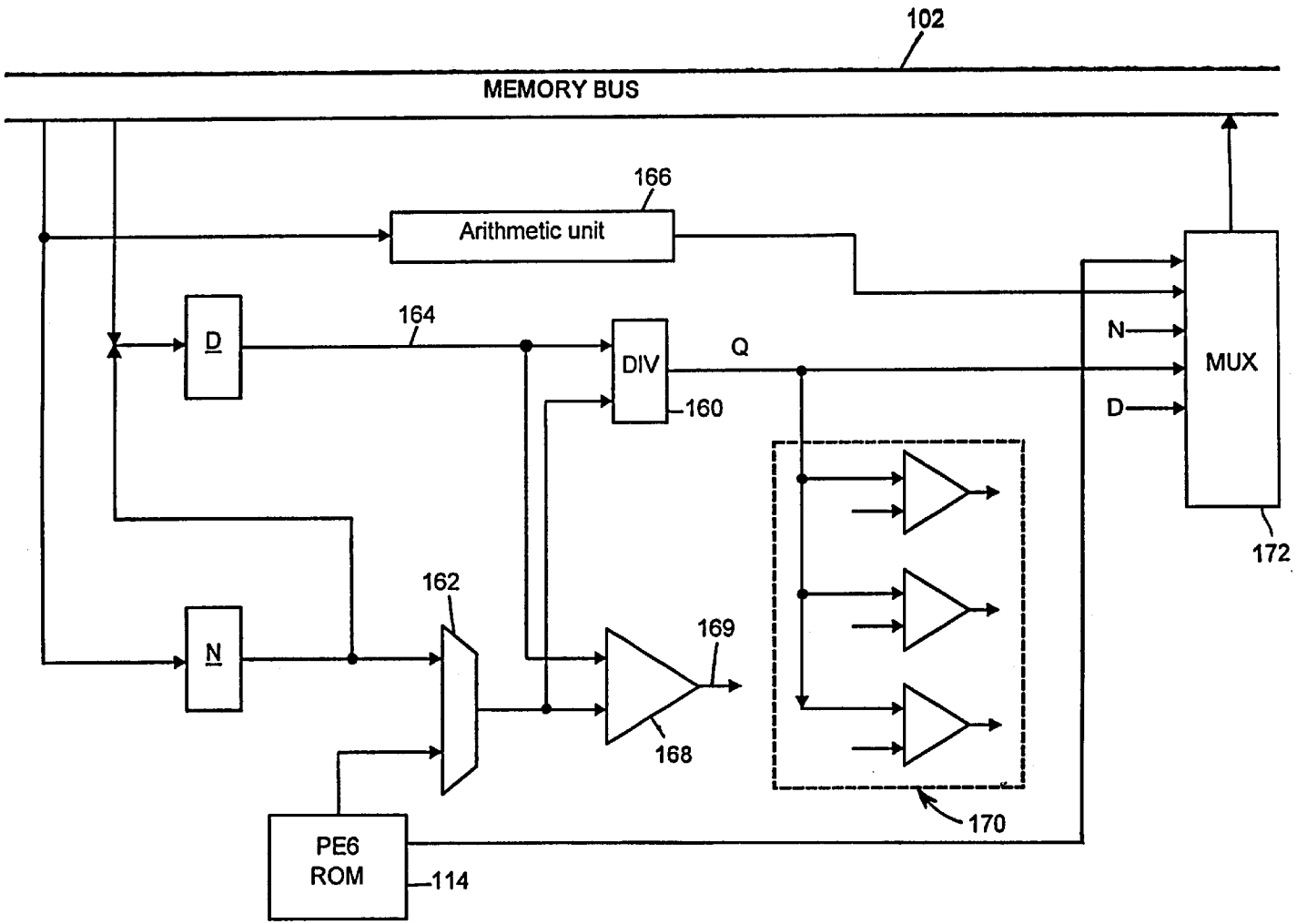
FIG. 5 is a block diagram of an auxiliary processing element of the LD-CELP processor of FIG. 3.

Referring now to FIG. 5, the auxiliary processing element PE6 operates on 32-bit floating point or 8-bit integer data and performs operations such as data type conversion, rounding, negating, parallel comparison, mantissa and exponent extraction, and various logic operations. The processing element PE6 also performs a 32-bit floating point division operation preferably in 14 clock cycles with the result available via the data bus 102. The particular operation to be performed is determined by a five-bit opcode selected by the controller 116. For example, opcodes may be used to select between three types of operations for a division unit 160: normal floating point division (Q=N/D), negative division (Q=−N/D), and gain quantization (see below for further details).

To accomplish these operations, the auxiliary processing element PE6 includes two registers D and N that hold data provided via the data bus 102 for processing. For the division operation, data is preferably loaded into the register N first, followed by data entry into the register D. The register N is coupled to the division unit 160 via a multiplexer 162, while the register D is coupled to the division unit 160 via a line 164.

The auxiliary processing element PE6 also includes an arithmetic logic unit 166, a general-purpose comparator 168, and a gain quantization block. The arithmetic logic unit 166 performs data format conversions, rounding, limiting, maxima, minima, negation, and magnitude computations, all preferably within one clock cycle. In general, the comparator 168 compares two floating point numbers (e.g., one from the RAM 108 and the other from either the RAM 108 or the ROM 114 via the multiplexer 162). More particularly, the arithmetic logic unit 166 may use the comparator 168 when performing the maxima, minima, and limiting operations. The comparator 168 also preferably provides a flag on a line 169 to the controller 116 to alert the controller 116 to any conditions that would alter the processing flow.

The gain quantization block includes a bank of parallel comparators 170 and operates in conjunction with the division unit 160. More particularly, the comparators 170 preferably perform three comparisons in a single clock cycle on a value supplied from the division unit 160. The magnitude of this value is compared with three values supplied by the ROM 114. Values are then provided as output to a multiplexer 172 depending on these magnitude comparisons.

In general, the multiplexer 172 determines which output value (per clock cycle) will be provided to the data or memory bus 102. To this end, output terminals of the division unit 160, the arithmetic unit 166, the registers N and D, the ROM 114, and the gain quantization block 170 are all coupled to the multiplexer 172.

The controller 116 of the LD-CELP processor 100 will now be further described in connection with FIG. 6, which shows the major components of the controller 116 together with the processing array PE0–PE6 and the RAM 108. Generally, the controller 116 is a picobased programmable control comprising a picocode ROM 200, a pico-instruction decoder (or microcode ROM) 202, a sequencer 204, and a memory address unit 206. Alternatively, the controller may comprise a finite state machine. In this embodiment, however, the picocode ROM 200 contains the addresses of a set of control signals stored in the microcode ROM 202. This set of control signals (preferably 6500 15-bit words) may represent the entirety of the control signals necessary to implement the LD-CELP standard. For each address placed on the address bus 106 by the picocode ROM 200, the microcode ROM 202 decodes it and provides the corresponding control signal(s) on the control bus 104. Examples of control signals issued by the microcode ROM 202 include a data ready signal, various opcodes, and latch load signals. Both the picocode ROM 200 and the microcode ROM 202 may be external to the LD-CELP ASIC.

Each pico-instruction supplied by the picocode ROM 200 may be classified as either a vertical or horizontal instruction. Vertical instructions, which generally minimize instruction length, are those that effect a single operation such as load, add, save, and branch (see hereinbelow). These instructions preferably resemble machine language having an opcode field and an operand field, and may vary in length between 8 and 16 bits. The encoding of these instructions may be single or multi-leveled, the tradeoff being between the length of the instruction and the amount of decoding necessary to arrive at the microcode signal.

The sequencer 204 is preferably a hard-wired control sequencer that facilitates the transfer of data and information within the controller 116, including the control of the memory address unit 206 whenever data is retrieved from one of the memory blocks. In general, the sequencer 204 controls the sequence of events by pointing to a certain picocode in the picocode ROM 200 and, in so doing, determines the order in which picocodes are fetched from the picocode ROM 200. For example, when the picocode ROM 200 transmits an address to the microcode ROM 202, it also sends an acknowledge signal to the sequencer 204, which, in turn, updates a program counter 208. The program counter 208 preferably comprises a 13-bit register that stores the current address of the microcode ROM 202, which basically constitutes the current state of the chip. The sequencer 204 updates the program counter 208 by either incrementing it or loading it with a value corresponding to a branch destination. For example, if a flag signifying a desire to start encoder operation is set, the sequencer 204 would branch to the encoder portion of the encoder instructions, and update the program counter 208 accordingly.

In one embodiment, the sequencer 204 includes a 7-bit status register (not shown), the bits of which are set depending upon conditions that occur during execution. These conditions may also be set by external inputs via the I/O ports 118 and 120. The bits of the status register may correspond with certain states of the program counter 208, encoder v. decoder operation, speech v. non-speech input data, whether execution of a hybrid window module is occurring (to skip predictor coefficient routines), and whether the comparator 168 of the auxiliary processing unit PE6 has found the value in register N to be greater than or equal to the value in register D.

The memory address unit 206 performs address storage and address calculations necessary to address data in the various memory blocks, e.g., the RAM 108 and the codebook ROM 110. This arithmetic is preferably performed both linearly and circularly. The memory address unit 206 preferably includes an address arithmetic unit (not shown) that computes the necessary addresses using unsigned integers, an 11-bit adder (not shown), and an 11-bit comparator (not shown). The comparator may perform "greater-than-or-equal-to" or "equal-to" comparisons depending on the instructions (i.e., addresses) from the picocode ROM 200 in connection with, for instance, checking for either an upper or lower boundary of a circular buffer so that the pointer remains within the boundaries of the buffer. The memory address unit 206 may further include multiple register banks (not shown) for storing pointers, constants, upper and lower boundary values of the circular buffer, intermediate addresses, and the starting and current addresses of the RAM 108, codebook ROM 110, etc.

Circular (or modular) addressing is particularly well suited for efficient implementation of convolution and correlation computations. In a circular addressing scheme, the memory block may be considered a buffer that provides a sliding window containing new data to be processed. As an example, the adder of the memory address unit 206 initially computes a particular address by adding the contents of a register storing a starting address to the contents of another register storing an offset value. The resulting sum is then compared by the comparator of the memory address unit 206 to the boundary values of the buffer (which are stored in yet other registers). If the sum exceeds a boundary value, the address arithmetic unit of the memory address unit 206 wraps around to the top of the circular buffer.

Figure 6:
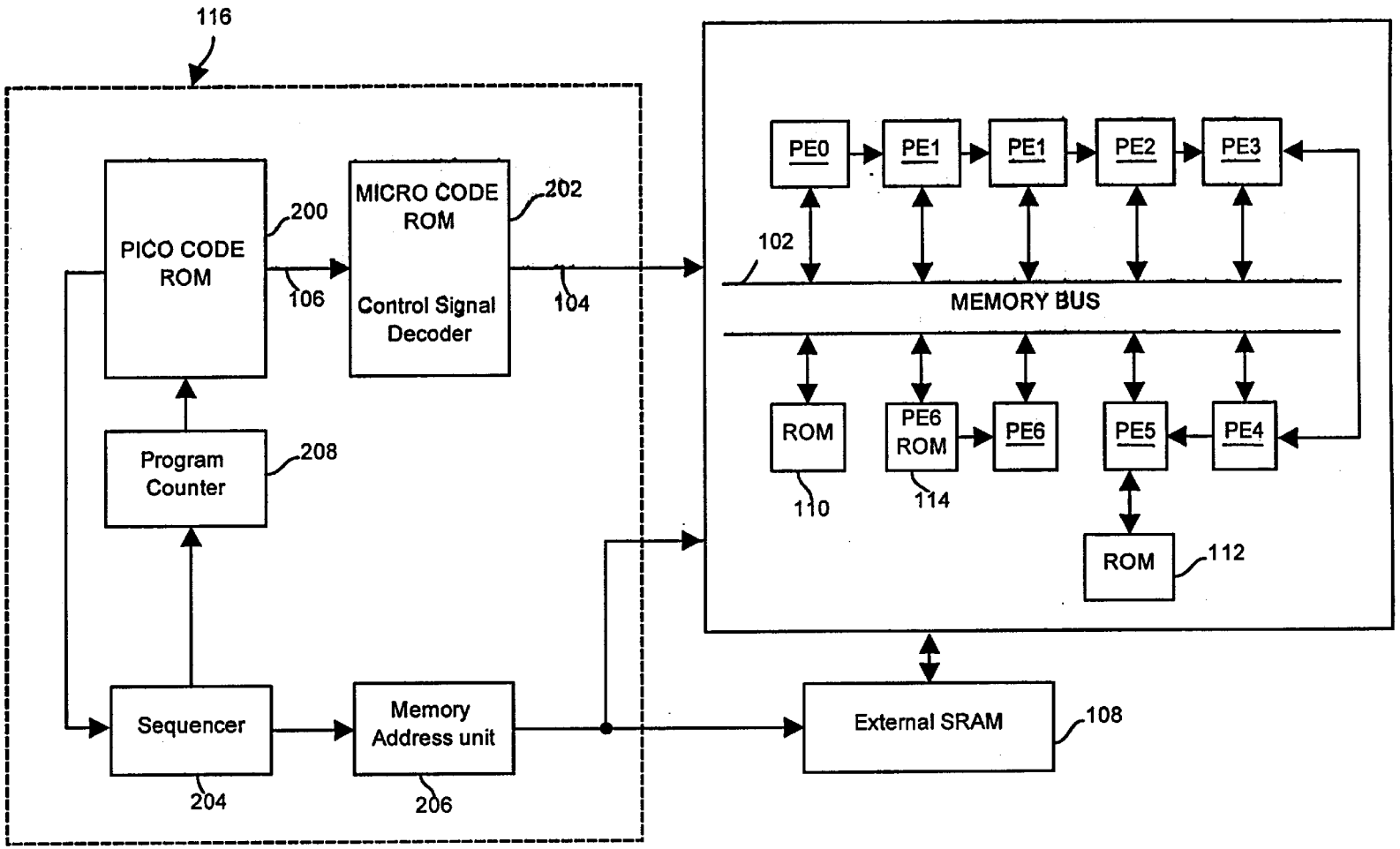
FIG. 6 is a block diagram of a picocode-based programmable controller of the LD-CELP processor of FIG. 3 shown together with a portion of the LD-CELP processor.
Figure 7:
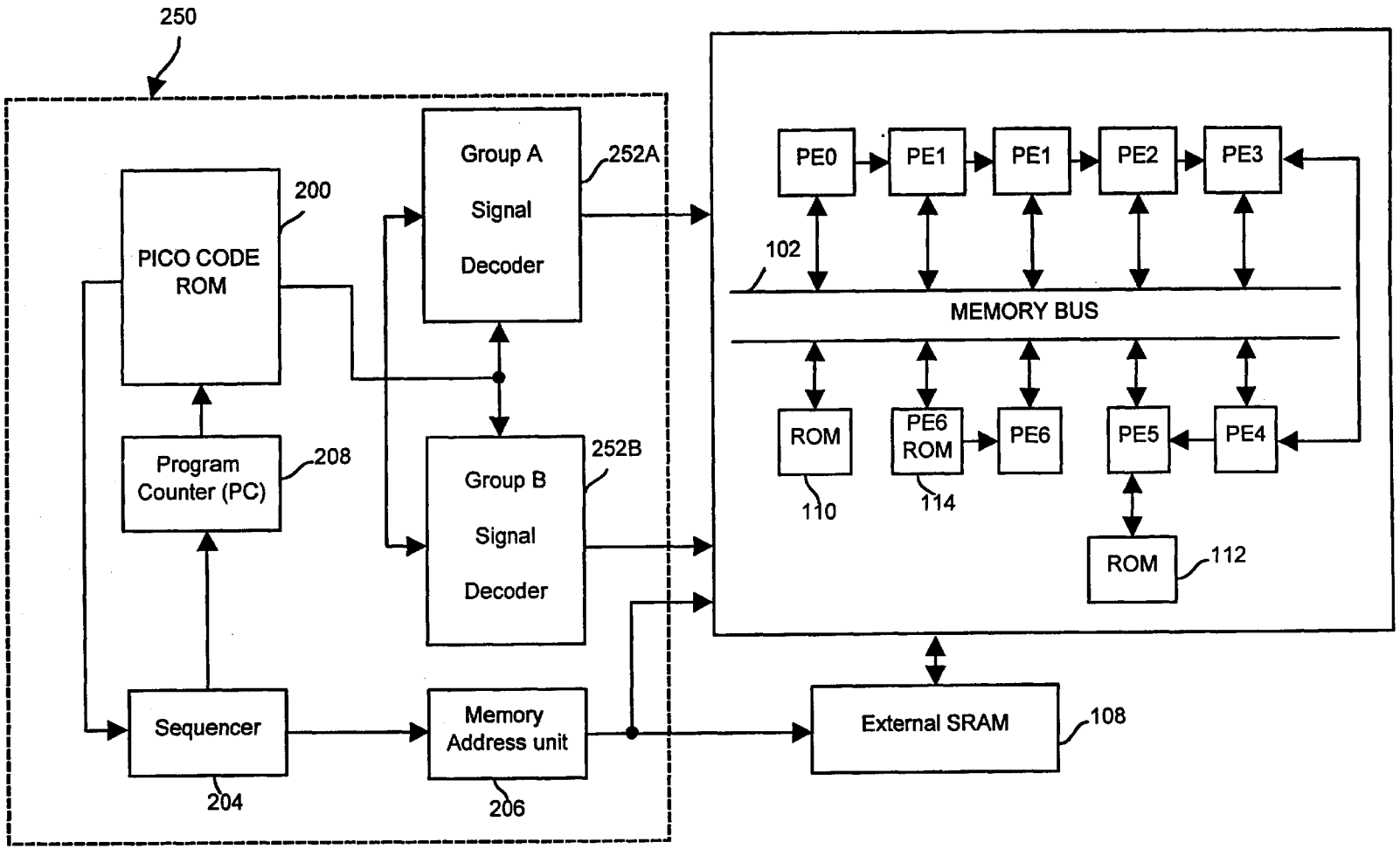
FIG. 7 is a block diagram of an alternative picocode-based programmable controller shown together with a portion of the LD-CELP processor of FIG. 3.

With reference to FIG. 7, an alternative controller 250 includes two independent picocode decoders 252A and 252B instead of the single microcode ROM 202 of the embodiment shown in FIG. 6. This alternative embodiment reduces the storage size of the memory block, which could be quite large if, for example, each set of control signals has 70 control bits. Dividing the instruction code ROM into two groups (Group A and Group B) may result in much lower costs. Group A may consist of 38 control signals for such frequently performed operations like load, memory read, and memory write, while Group B may consist of 32 control signals for more specialized operations like "clear accumulator" and opcode selection.

It shall be noted that the above-described ASIC architecture for implementation of the LD-CELP standard may comprise a hard-wired, non-programmable controller or a programmable controller. While the complexity of the LD-CELP standard may favor the above-described programmable approach, other embodiments of the present invention that incorporate a more hard-wired approach may provide improvements in processing speed. In this same fashion, it shall be understood by those skilled in the art that various embodiments of the present invention may trade slower processing times effected by, for instance, delays from accessing the microcode ROM 202, for the flexibility provided by a programmable approach.

Numerous other modifications and alternative embodiments of the invention will be apparent to those skilled in the art in view of the foregoing description. Accordingly, this description is to be construed as illustrative only. The details of the apparatus may be varied substantially without departing from the spirit of the invention, and the exclusive use of all modifications which are within the scope of the appending claims is reserved.

What is claimed is:

1. An integrated circuit for processing a speech signal in accordance with a CELP standard, comprising:

a data bus;

a plurality of processing elements coupled to the data bus in parallel wherein each processing element includes a multiplier and an accumulator; and an auxiliary processing element coupled to the data bus and having a division unit and a comparator;

wherein the plurality of processing elements and the auxiliary processing element are coupled in a pipeline formation.

2. The integrated circuit of claim 1, wherein the plurality of processing elements comprises a number of identical basic processing elements.

3. The integrated circuit of claim 2, wherein the plurality of processing elements comprises a further processing element differing from the identical basic processing elements and having a memory coupled thereto.

4. The integrated circuit of claim 2, wherein the number of identical basic processing elements corresponds with the dimension of a vector of the speech signal to be processed.

5. The integrated circuit of claim 4, wherein the plurality of processing elements comprises five identical basic processing elements.

6. The integrated circuit of claim 1, wherein:

each processing element of the plurality of processing elements further comprises a multiplexer and an adder; and the multiplexer of a first processing element of the plurality of processing elements has a first input coupled to an output terminal of the accumulator of the first processing element and a second input terminal coupled to an output terminal of the accumulator of a second processing element of the plurality of processing elements.

7. The integrated circuit of claim 1, wherein the multiplier of a first processing element of the plurality of processing elements has a first input terminal coupled, via a multiplexer, to the data bus and an output terminal of a second processing element of the plurality of processing elements.

8. The integrated circuit of claim 7, wherein the multiplier of the first processing element has a second input terminal coupled, via a further multiplexer, to the data bus and a memory.

9. The integrated circuit of claim 1, further comprising a global controller that directs implementation of the LD-CELP standard by the plurality of processing elements and the auxiliary processing element.

10. The integrated circuit of claim 9, wherein:

the global controller comprises a first memory and a second memory; and the first memory stores a plurality of codes for invoking one or more control signals of a plurality of control signals stored in the second memory.

11. The integrated circuit of claim 1, in combination with a codebook ROM coupled to the data bus and storing quantized speech vectors.

12. A speech coder for implementing a CELP standard to code a speech signal, comprising:

a data bus;

a first memory coupled to the data bus and storing quantized speech vectors;

a plurality of processing elements that operate on the quantized speech vectors and the speech signal wherein:

each processing element of the plurality of processing elements is coupled to the data bus;

adjacent processing elements of the plurality of processing elements are coupled in a pipeline formation;

the plurality of processing elements comprises multiple multiply-accumulate processing elements and an auxiliary processing element having a division unit and a comparator; and a second memory coupled to the auxiliary processing element and storing constant values utilized by the comparator of the auxiliary processing element.

13. The speech coder of claim 12, further comprising a third memory storing values associated with the LD-CELP standard wherein the third memory is coupled to one of the multiple multiply-accumulate processing elements.

14. The speech coder of claim 12, wherein the dimension of a vector of the speech signal to be processed is not greater than the number of the multiple multiply-accumulate processing elements.

15. The speech coder of claim 12, further comprising a global controller that directs implementation of the LD-CELP standard by the plurality of processing elements.

16. The speech coder of claim 15, wherein:

the global controller comprises a first memory and a second memory; and the first memory stores a plurality of codes for invoking one or more control signals of a plurality of control signals stored in the second memory.

* * * * *